US012520949B2

(12) United States Patent
Alletto, Jr.

(10) Patent No.: US 12,520,949 B2
(45) Date of Patent: Jan. 13, 2026

(54) BEDDING SYSTEM

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 368 days.

(21) Appl. No.: 18/116,439

(22) Filed: Mar. 2, 2023

(65) Prior Publication Data

US 2023/0276947 A1 Sep. 7, 2023

Related U.S. Application Data

(60) Provisional application No. 63/316,072, filed on Mar. 3, 2022.

(51) Int. Cl.
*A47C 21/02* (2006.01)

(52) U.S. Cl.
CPC ..... *A47C 21/022* (2013.01)

(58) Field of Classification Search
CPC ..... A47C 21/02; A47C 21/022; A47C 21/026; A47C 31/02
See application file for complete search history.

(56) References Cited

U.S. PATENT DOCUMENTS 588,427 A * 8/1897 Heath ..... A47C 21/022 5/498
2,995,762 A * 8/1961 Albinson ..... A47C 23/00 5/411
4,899,404 A * 2/1990 Galumbeck ..... A47C 20/041 5/616
2005/0144727 A1* 7/2005 Lage ..... A47C 31/105 5/691
2006/0059629 A1* 3/2006 Antinori ..... A47C 21/026 5/411
2008/0276373 A1* 11/2008 Clenet ..... A47C 21/026 5/618
2013/0326814 A1* 12/2013 Shan ..... A61G 7/002 5/613
2014/0123392 A1* 5/2014 Shan ..... A47C 21/026 5/618
2014/0245536 A1* 9/2014 Ermalovich ..... A61G 7/002 5/658
2016/0120328 A1* 5/2016 Wang ..... A47C 21/022 24/72.5
2023/0066732 A1* 3/2023 Gray ..... A47C 21/022
2023/0363546 A1* 11/2023 Aramli ..... A61G 7/015

OTHER PUBLICATIONS

European Patent Office, P.O. 5818, Patentlaan 2, 2280 HV Rijswijk, Netherlands, International Search Report International application No. PCT/US2023/014326, Date of mailing of the international search report: Jun. 19, 2023.

* cited by examiner

*Primary Examiner* — George Sun
(74) *Attorney, Agent, or Firm* — Sorell, Lenna & Schmidt, LLP

(57) ABSTRACT

A bedding system includes a base having a bracket and a cushion having a rod. The rod is configured to removably engage the bracket to couple the cushion to the base in a manner that prevents relative movement between the cushion and the base.

19 Claims, 11 Drawing Sheets

BEDDING SYSTEM

TECHNICAL FIELD

The present disclosure generally relates to bedding, and more particularly to bedding systems that include a first article of bedding having at least one first mating feature and a second article having at least one second mating feature configured to engage the first mating feature(s) to prevent relative movement between the second article of bedding and the first article of bedding.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

During use of a first article of bedding, such as, for example, a mattress, the mattress can move relative to a second article of bedding, such as, for example, a base on which the mattress is placed as a sleeper tosses and turns, causing a disruption in sleep. Furthermore, mattresses that are used in conjunction with movable bases have a tendency to move relative to the base as the base moves. Still further, mattresses may move relative to the base when a sleeper is getting into and/or out of bed, thus causing him or her to frequently reposition the mattress on the base.

Conventional solutions have included a bracket that is attached to base and projects beyond the footprint of the mattress and the base to engage a foot end of the mattress. However, since the bracket projects beyond the footprint of the mattress and the base, the bracket is not hidden from view, causing aesthetic issues. Furthermore, since the bracket engages the foot end of the mattress, the bracket deforms the mattress over time. Still further, the bracket tends to bend over time as forces from the mattress act on the bracket, causing the consumer to repair or replace the bracket. This disclosure describes an improvement over these prior art technologies.

SUMMARY

In one embodiment, in accordance with the principles of the present disclosure, a bedding system is provided that includes a base comprising a bracket and a cushion comprising a rod. The rod is configured to removably engage the bracket to couple the cushion to the base in a manner that prevents relative movement between the cushion and the base.

In some embodiments, the rod is configured to engage the bracket in a snap-fit configuration. In some embodiments, the bracket comprises a body and a flange extending from the body, the rod being positioned between the flange and the body when the rod engages the bracket.

In some embodiments, the bracket comprises a body, the bracket defining a groove extending into a surface of the body and comprising and a flange extending from the body, the groove and an inner surface of the flange defining a channel, the rod being disposed in the channel when the rod engages the bracket. In some embodiments, the flange has a first end connected directly to the body and an opposite second end, the bracket defining a gap between the second end and the body, the gap being in communication with the channel, the rod having a diameter greater than a width of the gap from the second end to the body. In some embodiments, the rod is configured to be inserted into and removed from the channel, the flange being configured to deflect relative to the body as the rod is inserted into the channel. In some embodiments, the rod is configured to be inserted into and removed from the channel, the channel being configured to expand as the rod is inserted into the channel. In some embodiments, the rod is configured to be inserted into and removed from the channel, the flange being configured to deflect relative to the body as the rod is removed from the channel. In some embodiments, the rod is configured to be inserted into and removed from the channel, the channel being configured to expand as the rod is removed from the channel. In some embodiments, the rod has a cylindrical configuration and the channel has a shape that conforms to the cylindrical configuration. In some embodiments, the groove is concave and the flange is C-shaped.

In some embodiments, the bracket comprises spaced apart first and second brackets. In some embodiments, the brackets each comprise a body, the brackets each defining a groove extending into a surface of the body of a respective one of the brackets and comprising and a flange extending from the body of a respective one of the brackets, the groove of a respective one of the brackets and an inner surface of the flange of a respective one of the brackets defining a channel, the channels being coaxial, the rod being disposed in the channels when the rod engages the brackets.

In some embodiments, the bracket is coupled to the base by a plurality of screws. In some embodiments, the cushion comprises opposite top and bottom panels and a cushioning material therebetween, the cushion comprising a pocket coupled to the top panel, the rod being positioned in the pocket. In some embodiments, the pocket is spaced apart from the bracket when the rod engages the bracket.

In some embodiments, the cushion comprises opposite top and bottom panels and a cushioning material therebetween, the cushion comprising spaced apart pockets coupled to the top panel, the rod being positioned in the pockets. In some embodiments, the pockets are spaced apart from the bracket when the rod engages the bracket.

In one embodiment, in accordance with the principles of the present disclosure, a bedding system is provided that includes a base comprising spaced apart first and second brackets. The brackets each include a body, a groove extending into the body and a flange extending from the body such that the groove and the flange define a channel. The channels are coaxial. A mattress comprises opposite top and bottom panels and a fill material therebetween. The mattress comprises a pocket coupled to the top panel. The mattress comprises a rod positioned in the pocket. The rod is configured to be removably disposed in the channels to couple the mattress to the base in a manner that prevents relative movement between the mattress and the base.

In one embodiment, in accordance with the principles of the present disclosure, a bedding system includes a base comprising spaced apart first and second brackets. The brackets are each coupled to the base by a plurality of screws. The brackets each include a body, a groove extending into the body and a flange extending from the body such that the groove and the flange define a channel. The brackets each including a gap between the flange and the body, the flange being in communication with the channel, the channels being coaxial. A mattress comprises opposite top and bottom panels and a fill material therebetween. The mattress comprises spaced apart pockets coupled to the top panel. The mattress comprises a rod positioned in the pockets. The rod has a diameter greater than widths of the gaps. The rod is configured to be removably disposed in the channels to couple the mattress to the base in a manner that prevents relative movement between the mattress and the base.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
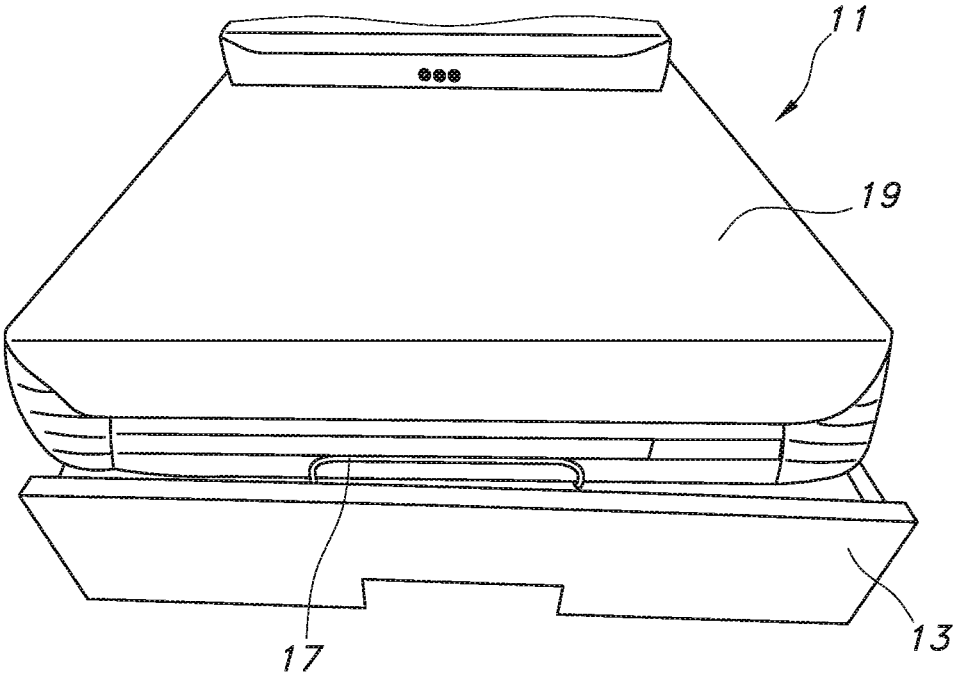
FIG. 1 is a perspective view of a prior art mattress retainment system.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

In some embodiments, the bedding system disclosed herein includes a first article of bedding having at least one first mating feature and a second article having at least one second mating feature configured to engage the first mating feature(s) to prevent relative movement between the second article of bedding and the first article of bedding. In some embodiments, the first mating feature is a clip, such as, for example, a bracket and the second mating feature is a bar, such as, for example, a rod. In some embodiments, the first and second articles of bedding can be any types of bedding in which preventing and/or restricting relative movement between the two articles of bedding is desired. For example, in some embodiments, the first article of bedding and/or the second article of bedding can be selected from mattress bases, adjustable mattress bases, mattresses, mattress toppers, mattress covers, sheets, cushions, spring packs. In some embodiments, the first article of bedding and/or the second article of bedding can include components of a bedding product, such as, for example, a mattress. For example, in some embodiments, the first article of bedding can include a spring pack of a mattress and the second article of bedding can include a cushioning or comfort layer of the mattress.

In some embodiments, the bedding system of the present disclosure includes a combination of (a) two spaced apart inline brackets, each having a C-shaped protrusion, that are located on top face of a mattress base at foot area and (b) an elongated bar removably held by straps/pockets sewn on bottom face of overlying mattress at corresponding foot area. The combination of the bar and the brackets is adapted so a user can move the mattress to align the bar with the brackets and comfortably fit or clip-in the bar within the openings of the C-shaped protrusions. The combination's purpose is to largely hold the mattress in place relative to the base. It is noted that this is especially useful for mattresses used atop an adjustable base.

In some embodiments, each bracket has C-shaped protrusion opening that faces away from foot end and towards middle of base so once the bar is inserted and held within it, the combination of the bar and the brackets can resist movement of the mattress, e.g., largely sliding of the foot end, off the base.

In some embodiments, the bar is removable from the mattress straps/pockets. It is noted that in contrast to prior art mattress retainment systems, the bar is hidden from view, the bar does not project beyond mattress/base footprint, the bar will not deform mattress edge to resist movement, the bar will not be subject to forces that tend to bend bar over time, the bar is integral to mattress and located away from edge so motion resistance is stronger and the bar can work with inline brackets already existing on bases, thus providing several advantages to the disclosed bedding system over prior art mattress retainment systems, which lack such features.

As used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

Figure 2:
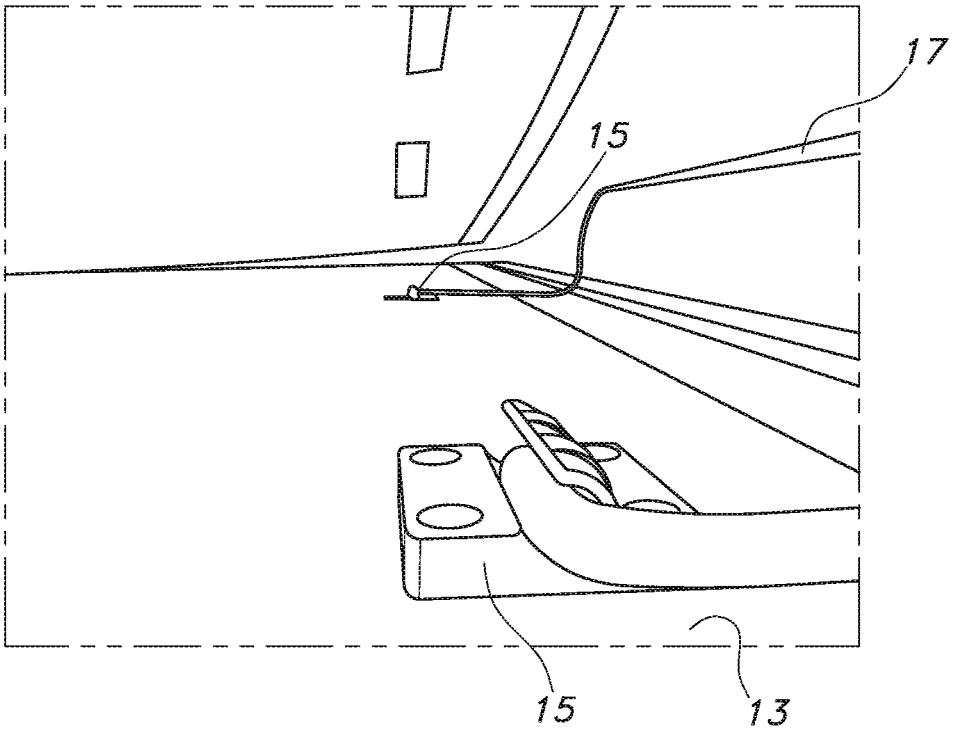
FIG. 2 is a perspective view of components of the prior art mattress retainment system shown in FIG. 1.

As shown in FIGS. 1 and 2, a prior art mattress retaining system 11 includes a base 13 having a pair of spaced apart clips 15 and a bracket 17 that is coupled to clips 15. Bracket 17 projects beyond a footprint of a mattress 19 of system 11 such that bracket 17 engages a foot end of mattress 19, as shown in FIG. 1. Since bracket 17 projects beyond the footprint of mattress 17, bracket 17 is not hidden from view, causing aesthetic issues. Furthermore, since bracket 17 engages the foot end of mattress 19, bracket 17 will deform at least the foot end of mattress 19 over time. Still further, bracket 17 tends to bend over time as forces from mattress 19 act on bracket 17, causing the consumer to repair or replace bracket 17. These and other problems have been overcome by the disclosed bedding system, as discussed in detail hereinbelow.

The following discussion includes a description of a bedding system in accordance with the principles of the present disclosure. Alternate embodiments are also disclosed. Reference will now be made in detail to the exemplary embodiments of the present disclosure, which are illustrated in the accompanying figures. Turning to FIGS. 3-15, there are illustrated components of a bedding system 20 in accordance with the principles of the present disclosure.

System 20 includes a first article of bedding 22 and a second article of bedding 24 that is configured to be coupled to first article of bedding 22 to prevent and/or reduce relative movement between second article of bedding 24 and first article of bedding 22. In one embodiment, shown in FIGS. 3-13, first article of bedding 22 is a platform, such as, for example, a mattress base 26 and second article of bedding 24 is a cushion, such as, for example, a mattress 28 that is configured to be positioned on top of base 26. In some embodiments, base 26 is a fixed base such that ends of base 26 do not move relative to one another. In some embodiments, base 26 is a movable base such that ends of base 26 are rotatable or otherwise movable relative to one another. In some embodiments, base 26 is the same or similar to that provided in U.S. patent application Ser. No. 15/925,946, filed Mar. 20, 2018, which issued as U.S. Pat. No. 11,116,325 on Sep. 14, 2021 and is expressly incorporated by reference herein, in its entirety.

Figure 3:
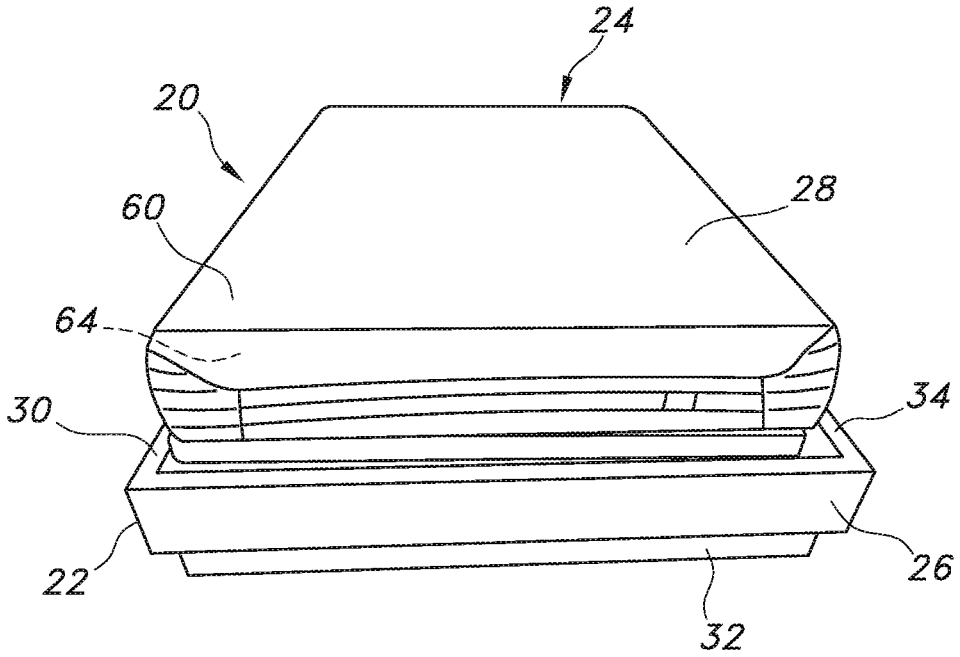
FIG. 3 is a perspective view of one embodiment of a bedding system, in accordance with the principles of the present disclosure.

In some embodiments, base 26 includes a frame 30 having an end 32 that is configured to directly engage a floor F of a room R, for example, as shown in FIG. 3. Frame 30 defines a cavity 34. Base 26 includes a base insert 36 positioned in cavity 34 such that insert 36 is removable from cavity 34. However, it is envisioned that base 26 may be provided without frame 30 or with frame 30 integrally and/or monolithically formed with insert 36.

Figure 4:
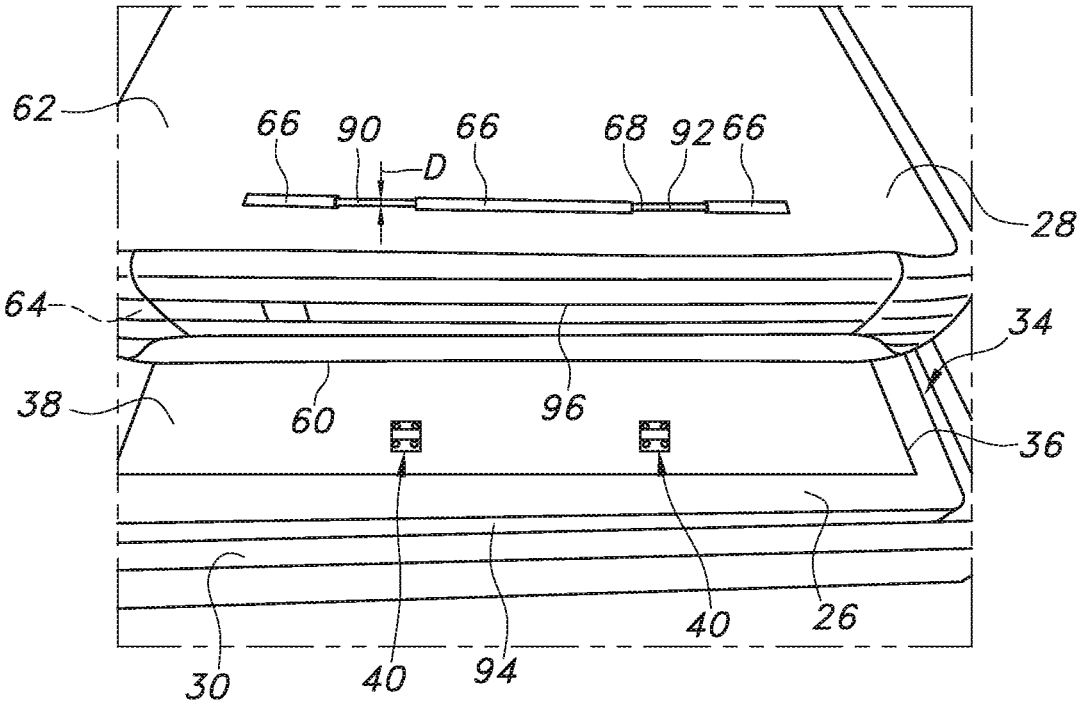
FIG. 4 is a perspective view of components of the bedding system shown in FIG. 3, with a mattress component of the bedding system being inverted for purposes of illustration.
Figure 5:
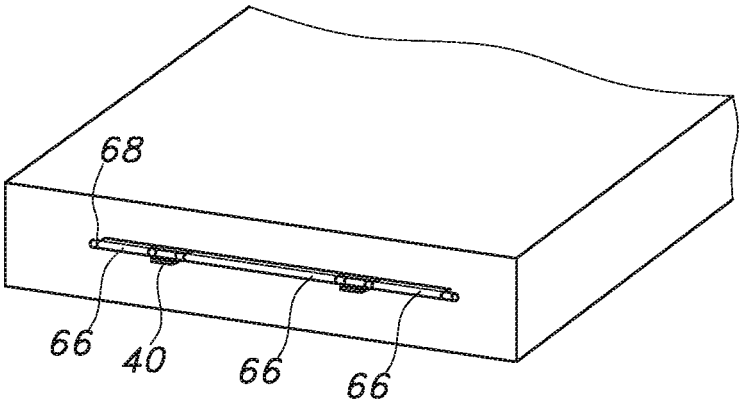
FIG. 5 is a perspective view, in part phantom, of components of the bedding system shown in FIG. 3.
Figure 8:
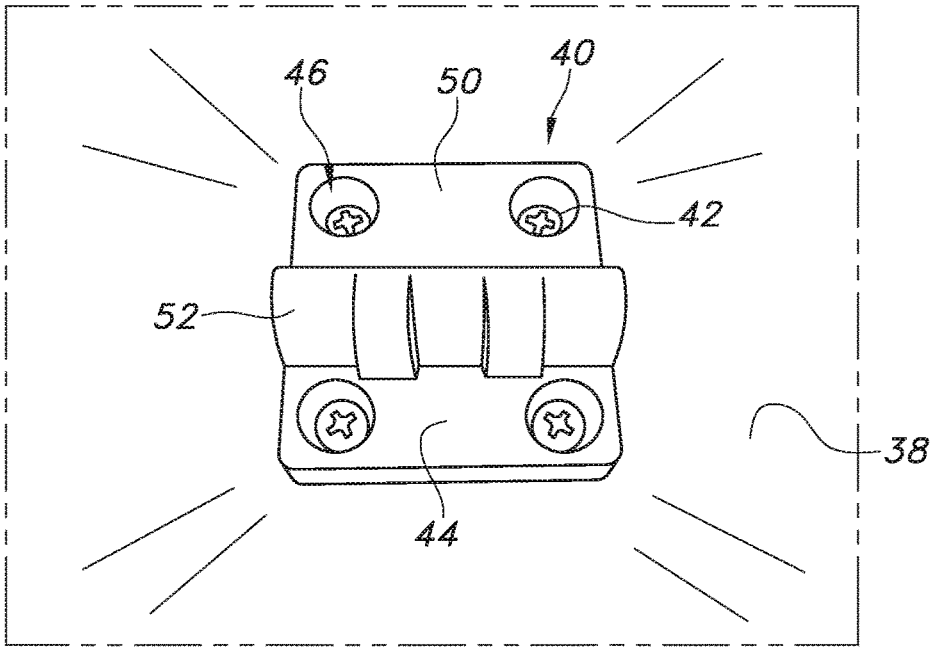
FIG. 8 is a perspective view of a component of the bedding system shown in FIG. 3.
Figure 9:
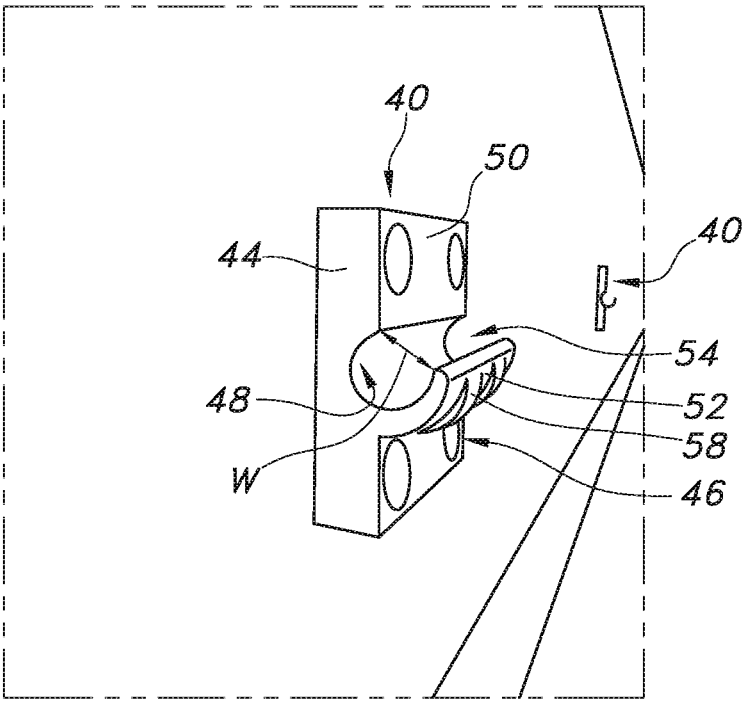
FIG. 9 is a perspective view of a component of the bedding system shown in FIG. 3.
Figure 10:
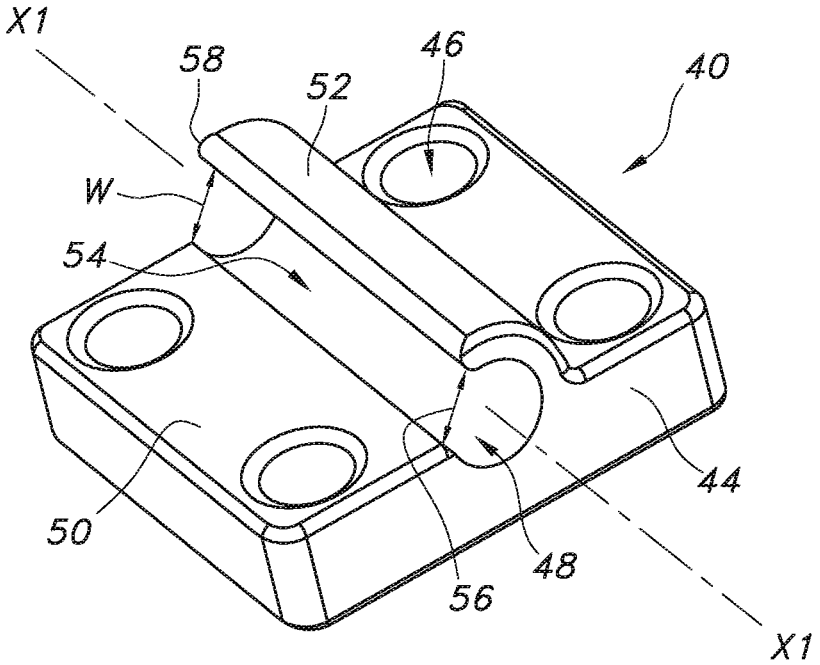
FIG. 10 is a perspective view of a component of the bedding system shown in FIG. 3.
Figure 11:
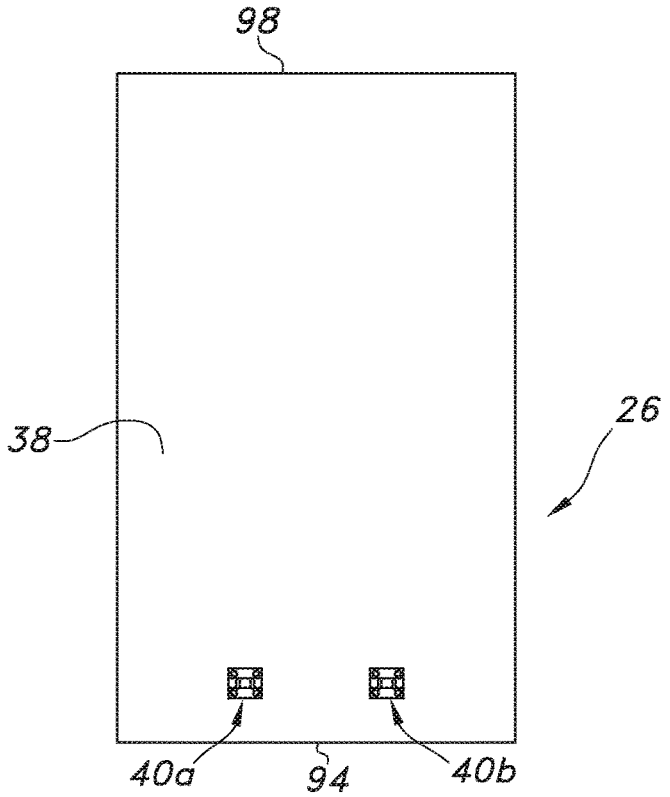
FIG. 11 is a top view of one embodiment of components of the bedding system shown in FIG. 3.
Figure 12:
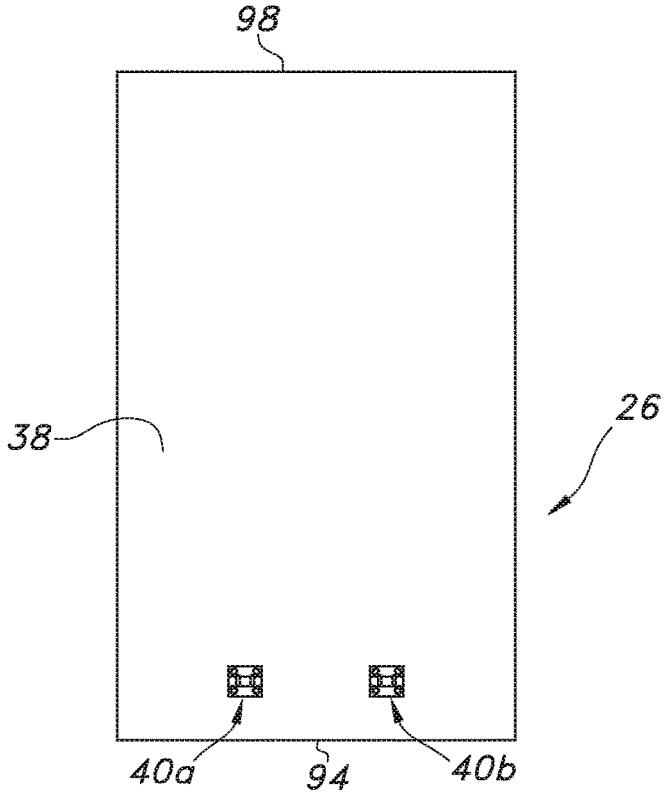
FIG. 12 is a top view of one embodiment of components of the bedding system shown in FIG. 3.
Figure 13:
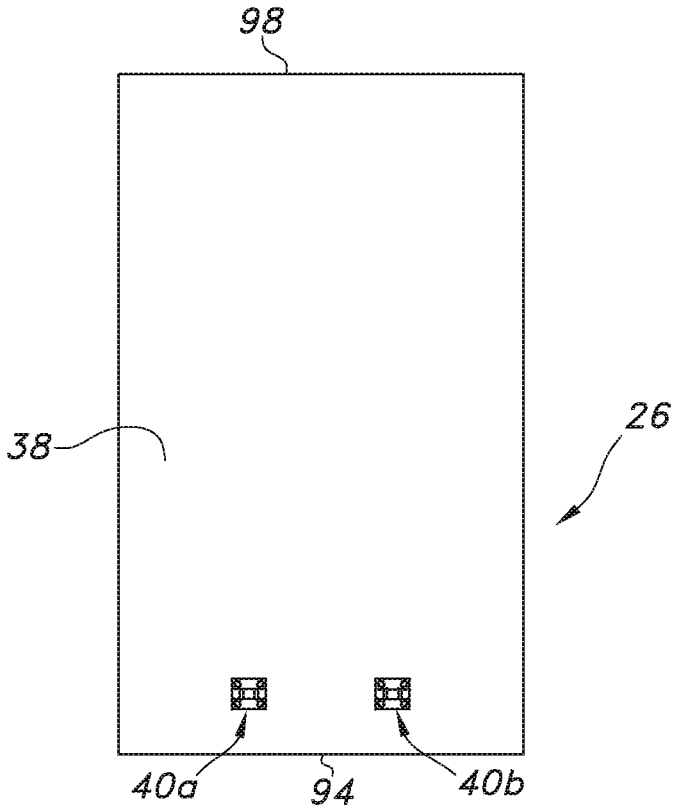
FIG. 13 is a top view of one embodiment of components of the bedding system shown in FIG. 3.

Insert 36 includes a bottom surface positioned adjacent to end 32 and an opposite top surface 38. Insert 36 includes one or a plurality of clips, such as, for example, brackets 40 coupled to surface 38, as shown in FIG. 4. In some embodiments, brackets 40 are each coupled to surface 38 using a plurality of screws 42, as shown in FIG. 8, for example. In particular, brackets 40 each include a body 44 and spaced apart holes 46 that each extend through a thickness of body 44. Screws 42 are inserted through holes 46 and into surface 38 to couple brackets 40 to surface 38. However, it is envisioned that brackets 40 may be coupled to surface 38 in any manner that prevents relative movement between brackets 40 on surface. For example, it is envisioned that brackets 40 may be variously coupled to surface 38, such as, for example, monolithic, integral connection, frictional engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, all or only a portion of each of brackets 40 is fabricated from a deformable material. In some embodiments, all or only a portion of each of brackets 40 is fabricated from a pliable, low-friction material, such as, for example, silicone, polyurethane, silicone-polyurethane copolymers, polymeric rubbers, polyolefin rubbers, elastomers, rubbers, thermoplastic elastomers, thermoset elastomers and elastomeric composites. In some embodiments, all or only a portion of each of brackets 40, such as for example, each of bodies 44 is fabricated from a semi-rigid or rigid configuration, relative to other components of brackets 40, such as, for example, flanges 52. For example, in some embodiments, bodies 44 are each made from a first material and flanges 52 are each made from a second material that is different and more deformable than the first material. In some embodiments, bodies 44 and flanges 52 are each made from the same material and flanges 52 are configured to deflect and/or deform relative to bodies 44 due to a difference in material characteristics, such as, for example, thickness. For example, in some embodiments, flanges 52 each have a thickness that is less than thicknesses of bodies 44 to allow flanges 52 to deflect and/or deform relative to bodies 44. In some embodiments, flanges 52 are each integrally and/or monolithically formed with one of bodies 44. In some embodiments, flanges 52 are each permanently fixed relative to one of bodies 44 such that flanges 52 cannot be moved relative to a respective one of bodies 44 without breaking one of flanges 52 that is associated with the respective one of bodies 44 and/or the respective one of bodies 44.

Brackets 40 each include a groove 48 extending into a surface 50 of body 44 and a flange 52 extending from body 44 such that groove 48 and flange 52 define a channel 54 configured for disposal of a component of mattress 28, as discussed herein. In some embodiments, channel 54 defines a longitudinal axis X1 Brackets 40 each include a gap 56 between a tip 58 of flange 52 and body 44, gap 56 being in communication with channel 54. Flanges 52 each include a first end coupled directly to body 44 and a opposite second end that includes tip 58. Brackets 40 are attached with surface 38 such that channels 54 and/or axes X1 are aligned and/or coaxial with one another to accommodate a linear component of mattress 28, as discussed herein. In some embodiments, groove 48 is concave and flange 52 is C-shaped. The surface of body 44 that defines groove 48 is continuous with the surface of flange 52 that defines a portion of channel 54 such that the surfaces of body 44 and flange 52 define a channel surface having a continuous radius of curvature and/or is continuously curved to provide channel 54 with an arcuate configuration that conforms to a cylindrical configuration of the linear component of mattress 28, as discussed herein. That is, the channel surface that defines channel 54 provide channel 54 with a semi-hemispherical or substantially semi-hemispherical configuration.

In some embodiments, the channel surface that defines channel 54 extends greater than 180 degrees about axis X1 in order to provide a snap-fit configuration with the linear component of mattress 28, as discussed herein. Indeed, by having the channel surface that defines channel 54 extend greater than 180 degrees about axis X1 allows a width of gap 56 to be less than a diameter of the linear component of mattress 28 such that gap 56 must expand to allow the linear component of mattress 28 to be inserted into and removed from channel 54, as discussed herein. In some embodiments, the channel surface that defines channel 54 extends between about 181 degrees and about 320 degrees about axis X1. In some embodiments, the channel surface that defines channel 54 extends between about 190 degrees and about 300 degrees about axis X1. In some embodiments, the channel surface that defines channel 54 extends between about 200 degrees and about 280 degrees about axis X1. In some embodiments, the channel surface that defines channel 54 extends between about 220 degrees and about 275 degrees about axis X1. In some embodiments, the channel surface that defines channel 54 extends about 275 degrees about axis X1. In some embodiments, the channel surface that defines channel 54 extends about 270 degrees about axis X1. In some embodiments, the channel surface that defines channel 54 extends greater than about 270 degrees about axis X1, such as, for example, between about 271 degrees and about 320 degrees about axis X1.

Mattress 28 a top panel 60 and an opposite bottom panel 62. Panel 60 defines a sleep surface of mattress 28 and is configured to support the body of one or more sleepers. Panel 62 directly engages surface 38 of base 26 when mattress 28 is coupled to base 26. In some embodiments, mattress 28 includes a cushioning material, such as, for example, a fill material 64 positioned between panel 60 and panel 62.

In some embodiments, fill material 64 includes a plurality of springs. In some embodiments, one or more of springs are enclosed within a pouch. In some embodiments, the springs are each positioned within a pocket, such as, for example, a fabric pocket. The pockets may be coupled to one another to form a string of pockets that each include one of the springs therein. In some embodiments, the string of pockets includes one or more slits between adjacent pockets to allow the springs to move independently of one another. In some embodiments, the string of pockets includes one or more slits that extend through a top surface of the string of pockets between adjacent pockets and/or one or more slits that extend through a bottom surface of the string of pockets between adjacent pockets. In some embodiments, mattress 28 includes a plurality of the strings of pockets. In some embodiments, the springs and/or pockets that form fill material 64 are the same or similar to those disclosed in U.S. patent application Ser. No. 15/220,964, filed on Jul. 27, 2016 and/or in U.S. patent application Ser. No. 15/616,269, filed on Jun. 7, 2017, which are expressly incorporated herein by reference, in their entireties.

In some embodiments, fill material 64 includes a foam, such as, for example, memory foam. However, it is envisioned that fill material 64 may include other materials, such as, for example, cotton, kapok, flax, linen, jute, ramie, hemp, kenaf, bamboo, coir, sisal, silk, wool (sheep), alpaca, llama, goat (mohair, cashmere), rabbit (angora), camel, horse, yak, vicuna, qiviut, guanaco, rayon, azlon, lyocell, acetate, triacetate, rubber, polyester, olefin, nylon, acrylic, modacrylic, aramid, and spandex. Various components of mattress 28 and/or fill material 64 may have material composites, including the above materials, to achieve various desired characteristics such as strength, rigidity, elasticity, compliance, mechanical performance, and durability. The components of mattress 28 and/or fill material 64, individually or collectively, may also be fabricated from a heterogeneous material such as a combination of two or more of the above-described materials.

Figure 6:
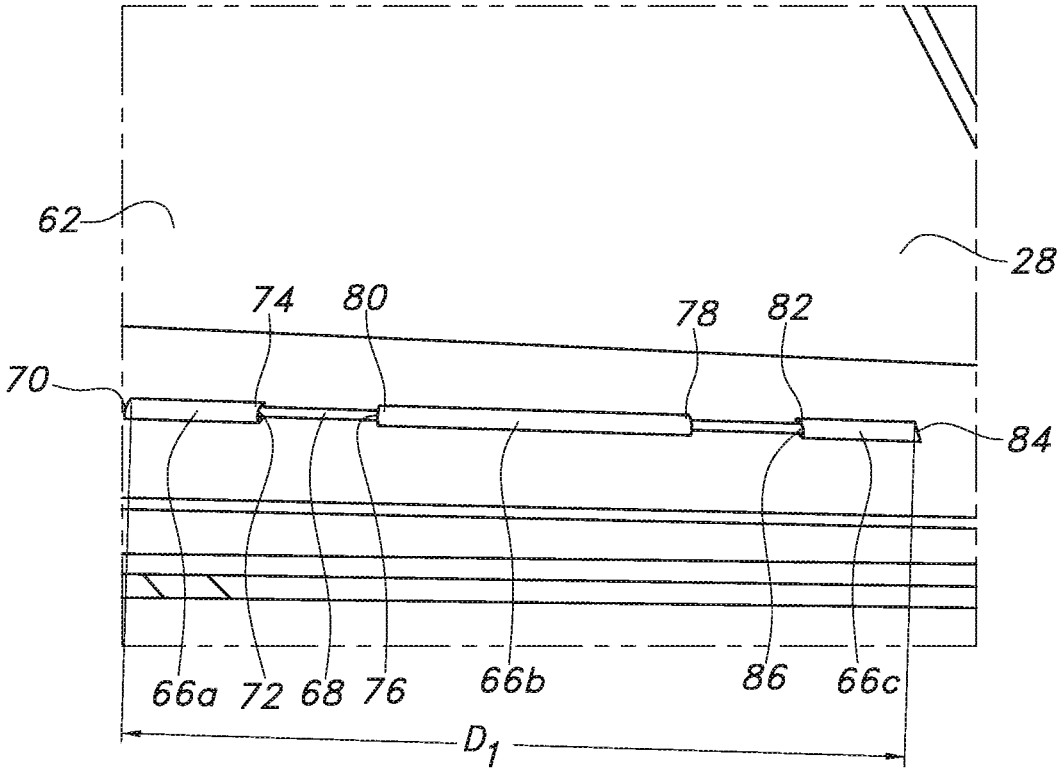
FIG. 6 is a perspective view of a component of the bedding system shown in FIG. 3, with the component of the bedding system being inverted for purposes of illustration.
Figure 7:
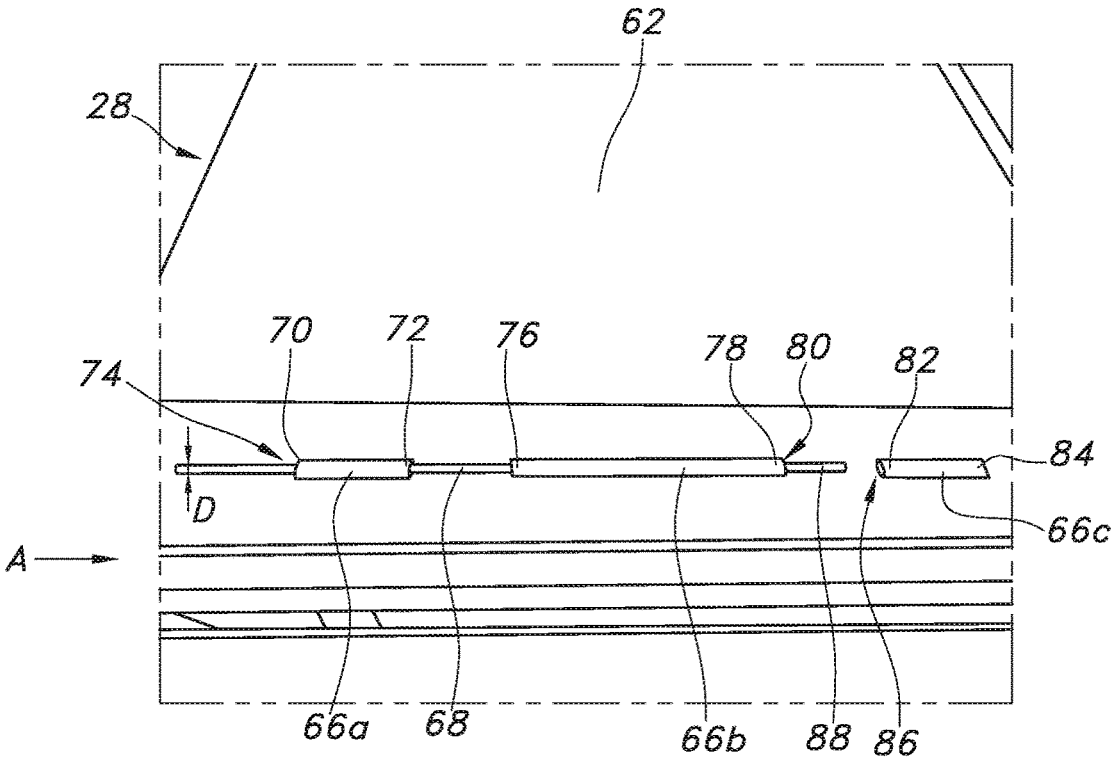
FIG. 7 is a perspective view of a component of the bedding system shown in FIG. 3, with the component of the bedding system being inverted for purposes of illustration.

Mattress 28 includes one or a plurality of pockets 66 coupled to panel 60 and a linear component, such as, for example, a bar or rod 68 positioned in pockets 66. In one embodiment, mattress 28 includes one pocket 66. In one embodiment, mattress 28 includes two pockets 66. In one embodiment, mattress 28 includes three pockets 66. In one embodiment, mattress 28 includes more than three pockets 66. In some embodiments, pockets 66 may include a pocket 66*a*, a pocket 66*b* and a pocket 66*c*, wherein pockets 66*a*, 66*b*, 66*c* are spaced apart from one another, as shown in FIGS. 6 and 7, for example. Pocket 66*a* includes opposite ends 70, 72 and defines a cavity 74 extending from end 70 to end 72. Pocket 66*b* includes opposite ends 76, 78 and defines a cavity 80 extending from end 76 to end 78. Pocket 66*c* includes opposite ends 82, 84 and defines a cavity 86 extending from end 82 to end 84. Pockets 66*a*, 66*b*, 66*c* are configured such that cavities 74, 80, 86 are aligned and/or coaxial with one another. When rod 68 is inserted into cavities 74, 80, 86, a portion 90 of rod 68 is positioned between pockets 66*a*, 66*b* and a portion 92 of rod 68 is positioned between pockets 66*b*, 66*c* as shown in FIGS. 4 and 6. In some embodiments, ends 70, 72, 76, 78, 82 are open to allow an end 88 of rod 68 to be inserted in the direction shown by arrow A in FIG. 7 through ends 70, 72, 76, 78, 82 and into cavity 86. In some embodiments, end 84 is closed to prevent end 88 from passing through end 84. It is noted that rod 68 may be removed from pockets 66*a*, 66*b*, 66*c* by moving rod 68 relative to pockets 66*a*, 66*b*, 66*c* in a direction that is opposite the direction shown by arrow A in FIG. 7, as discussed herein. An end surface of end 70 is a distance D1 apart from an end surface of end 84. In some embodiments, rod 68 has a maximum length L1 (FIG. 17) that is less than distance D1. In some embodiments, maximum length L1 is equal to distance D1. In some embodiments, maximum length L1 is greater than distance D1. In some embodiments, end 84 is open.

Pockets 66, such as, for example, pockets 66*a*, 66*b*, 66*c* are coupled to panel 60 in a manner that holds rod 68 in a removably close fit therein, reasonably tight to mattress 28. In some embodiments, pockets 66, such as, for example, pockets 66*a*, 66*b*, 66*c* are coupled to panel 60 via stitching, for example. However, it is also envisioned that pockets 66, such as, for example, pockets 66*a*, 66*b*, 66*c* may be variously connected with panel 60, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, pockets 66, such as, for example, pockets 66*a*, 66*b*, 66*c* may be connected with panel 60 via hook and loop fasteners (e.g., Velcro). In some embodiments, rather than having pockets coupled to panel 60, mattress 28 includes two or more slits that extend through a surface of panel 60 such that rod 68 can be woven in and out of the slits to couple rod 68 to panel 60.

In some embodiments, pockets 66, such as, for example, pockets 66*a*, 66*b*, 66*c* are sized and made of a fabric that provides little or no stretch to reduce and/or prevent lateral shifting of rod 68 within pockets 66*a*, 66*b*, 66*c* and/or reduces and/or prevents pull in a horizontal direction. It is envisioned that the fabric size and composition and the close fit allows mattress 28 to be tightly secured with base 26 and act effectively as a single body. That is, the fabric size and composition and the close fit allows mattress 28 to move with base 26 as base 26 moves.

In some embodiments, rod 68 is made of a rigid material, such as, for example, metal. In some embodiments, rod 68 is made from a different material than brackets 40. In some embodiments, rod 68 is made from a first material and brackets 40 are made from a second material that is different than the first material and has a lower durometer or greater softness than the first material such that forces applied to brackets 40 by rod 68 cause brackets 40 to deflect and/or deform, as discussed herein. In some embodiments, the second material has greater modulus of elasticity than the first material. In one embodiment, the second material has a stiffness (i.e., modulus of elasticity) of at least about 100 GPa and the stiffness of the first material is greater, such as at least about 110 GPa, 125 GPa, 190 GPa, and particularly within a range between about 100 GPa and about 250 GPa. In some embodiments, rod 68 has a cylindrical configuration. In some embodiments, rod 68 has a bar configuration and includes planar top and bottom surfaces that are joined by arcuate side surfaces. In some embodiments, rod 68 may have various cross section configurations, such as, for example, circular, oval, oblong, triangular, rectangular, square, polygonal, irregular, uniform, non-uniform, variable, tubular and/or tapered. In particular, rod 68 may a cross section configuration that matches and/or conforms to cross section configurations of channels 54 such that rod 68 is closely held within channels 54.

Portions 90, 92 are each configured for engagement with one of brackets 40 such that pockets 66*a*, 66*b*, 66*c* are spaced apart from brackets 40 when rod 68 is inserted into channels 54. In particular, portions 90, 92 are each configured for disposal in one of channels 54 such that rod 68 is positioned between flanges 52 and bodies 44 to couple mattress 28 to base 26. Portions 90, 92 are each moved through one of gaps 56 and into one of channels 54. Rod 68 has a uniform maximum diameter D along an entire length of rod 68. Diameter D is greater than a maximum width W of gaps 56 when brackets 40 are in a non-expanded or non-deformed configuration. In some embodiments, brackets 40 are in the non-expanded or non-deformed configuration when no external forces, except gravity and/or atmospheric pressure, are being applied to brackets 40 and/or rod 68 is spaced apart from brackets 40. Forces applied by rod 68 to flanges 52 as rod 68 is being pushed through gaps 56 and into channels 54 cause brackets 40 to move from the non-expanded or non-deformed configuration to an expanded or deformed configuration in which widths of gaps 56 is greater than width W and/or diameter D to allow rod 68 to be inserted through gaps 56 and into channels 54. In some embodiments, moving brackets 40 from the non-expanded or non-deformed configuration to the expanded or deformed configuration increases or expands channels 54. That is, the diameters of channels 54 increase or expand as brackets 40 move from the non-expanded or non-deformed configuration to the expanded or deformed configuration. Likewise, in some embodiments, moving brackets 40 from the expanded or deformed configuration to the non-expanded or non-deformed configuration decreases or contracts channels 54. That is, the diameters of channels 54 decrease or contract as brackets 40 move from the expanded or deformed configuration to the non-expanded or non-deformed configuration. In some embodiments, the widths of gaps 56 when brackets 40 are in the expanded or deformed configuration are equal to diameter D. In some embodiments, the widths of gaps 56 when brackets 40 are in the expanded or deformed configuration are greater diameter D.

Once rod 68 is inserted through gaps 56 and into channels 54, brackets 40 each move from the expanded or deformed configuration to the non-expanded or non-deformed configuration such that brackets 40 engage rod 68 to couple mattress 28 to base 26 in a snap-fit configuration. This prevents rod 68 from being removed from channels 54 and prevents and/or reduces relative movement between mattress 28 and base 26. That is, rod 68 cannot be removed from channels 54 without moving brackets 40 from the non-expanded or non-deformed configuration to the expanded or deformed configuration. Accordingly, to remove rod 68 from channels 54, rod 68 exerts forces on flanges 52 to move brackets 40 from the non-expanded or non-deformed configuration to the expanded or deformed configuration such that rod 68 can be removed from channels 54. Once rod 68 is removed from channels 54, brackets 40 move from the expanded or deformed configuration to the non-expanded or non-deformed configuration.

In operation and use, mattress 28 is coupled to base 26 by placing mattress 28 on top of base 26 such that panel 62 directly engages surface 38. An end 94 of base 26 is aligned with an end 96 of mattress 28 such that rod 68 is positioned adjacent to gaps 56 with brackets 40 in the non-expanded or non-deformed configuration. Rod 68 is being pushed through gaps 56 and into channels 54 by applying forces from rod 68 to flanges 52, which causes brackets 40 to move from the non-expanded or non-deformed configuration to the expanded or deformed configuration. Further force is applied to rod 68 when brackets 40 are in the expanded or deformed configuration to move rod 68 through gaps 56 and into channels 54. As rod 68 moves past gaps 56 and into channels 54, brackets 40 move from the expanded or deformed configuration to the non-expanded or non-deformed configuration to retain rod 68 within channels 54 in a manner that couples mattress 28 to base 26 to prevent or reduce relative movement between mattress 28 and base 26. This allows mattress 28 to remain in place relative to base 26 as ends of base 26 move and/or rotate relative to one another, as sleepers get in and out of bed and while sleepers are lying on top of mattress 28.

To remove mattress 28 from base 26, a force is applied to rod 68 such that rod 68 exerts forces on flanges 52 to move brackets 40 from the non-expanded or non-deformed configuration to the expanded or deformed configuration such that rod 68 can be removed from channels 54. Once rod 68 is removed from channels 54, brackets 40 move from the expanded or deformed configuration to the non-expanded or non-deformed configuration. Brackets 40 are then in position for receiving rod 68 to re-couple mattress 28 to base 26.

It is envisioned that brackets 40 can be variously oriented relative to base 26. For example, in one embodiment, shown in FIG. 11, brackets 40 include a bracket 40*a* and a bracket 40*b* wherein gaps 56 of brackets 40*a*, 40*b* each face an end 98 of base 26 that is opposite end 94. In one embodiment, shown in FIG. 12, brackets 40 include a bracket 40*a* and a bracket 40*b* wherein gaps 56 of brackets 40*a*, 40*b* each face end 94. In one embodiment, shown in FIG. 13, brackets 40 include a bracket 40*a* and a bracket 40*b* wherein gap 56 of bracket 40*a* faces end 98 and gap 56 of bracket 40*b* faces end 94. However, it is envisioned that this configuration may be reversed. That is, gap 56 of bracket 40*a* may be oriented to face end 94 and gap 56 of bracket 40*b* may be oriented to face end 98. It is envisioned that variously orienting brackets 40 relative to base 26 provides different options for engaging rod 68 with brackets 40 that may make coupling rod 68 with brackets 40 easier and/or provide a stronger connection between rod 68 and brackets 40.

It is noted that system 20 is shown in FIGS. 3-13 as having brackets 40 positioned adjacent to a foot end of base 26 (end 94) and rod 68 positioned adjacent a foot end of mattress 26 (end 96). However, it is envisioned that this configuration may be reversed. For example, brackets 40 may be positioned adjacent to a head end of base 26 that is opposite the foot end of base 26 and rod 68 may be positioned adjacent a head end of mattress 28 that is opposite the foot end of mattress 28. It is further envisioned that base 26 may include a first set of brackets 40 at the foot end of base 26 and a second set of brackets 40 at the head end of base 26. In such embodiments, mattress 26 can include a first rod 68 at the foot end of mattress 28 that engages brackets 40 at the foot end of base 26 and a second rod 68 at the head end of mattress 28 that engages brackets 40 at the head end of base 26. In some embodiments, base 26 may include one or more additional sets of brackets 40 between the set of brackets 40 at the head end of base 26 and the set of brackets 40 at the foot end of base 26 and mattress 28 may include one or more additional rods 68 between rod 68 at the head end of mattress 28 and rod 68 at the foot end of mattress 28 that engage the one or more additional sets of brackets 40 between the set of brackets 40 at the head end of base 26 and the set of brackets 40 at the foot end of base 26.

Figure 14:
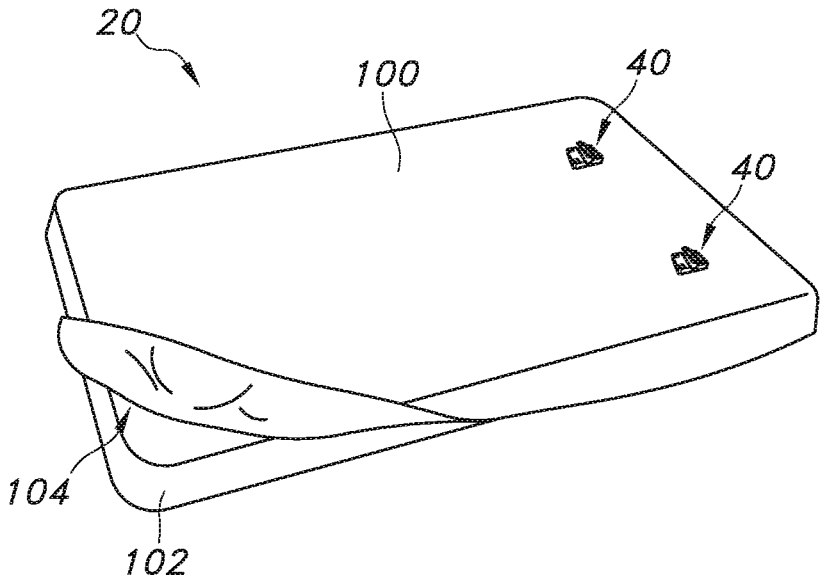
FIG. 14 is a perspective view of a component of the bedding system, in accordance with the principles of the present disclosure.

In one embodiment, shown in FIG. 14, system 20 includes a sheet 100 for use with a base 102 that does not include brackets, such as, for example, brackets 40 in order to couple a cushion, such as, for example, mattress 28 to base 102. In some embodiments, sheet 100 is similar to a fitted sheet that can be fitted over a mattress base, such as, for example, base 102 in the same manner as a fitted sheet is fitted over a mattress. Sheet 100 includes brackets 40 attached thereto in a manner that is the same or similar to the manner in which brackets 40 are attached to base 26. After sheet 100 is fitted over base 102, a cushion, such as, for example, mattress 28 can be coupled to base 102 and sheet 100 by inserting rod 68 of mattress 28 into channels 54 of brackets 40 of sheet 100 in the same manner as rod 68 is inserted into channels 54 of brackets 40 of base 26, discussed above, to prevent or reduce relative movement between mattress 28 and base 102 and sheet 100.

In some embodiments, sheet 100 is close fitting with base 102 in a manner that prevents relative movement between sheet 100 and base 102 when sheet 100 is fitted or otherwise coupled with base 102. For example, in some embodiments, sheet 100 may be made of stretch tight fabric that has at least some elasticity that allows sheet 100 to be expanded to fit over base 102 and then contract after sheet 100 is fitted over a base 102 to form a close fit with base 102. In some embodiments, base 102 has a volume that is greater than a volume defined by a cavity 104 of sheet 100 such that sheet 100 must be stretched to dispose base 102 within cavity 104. It is envisioned that the volume of cavity 104 will closely match the volume of base 102 after base 102 is disposed within cavity 104 due to the elastic properties and/or characteristics of sheet 100, for example.

Figure 15:
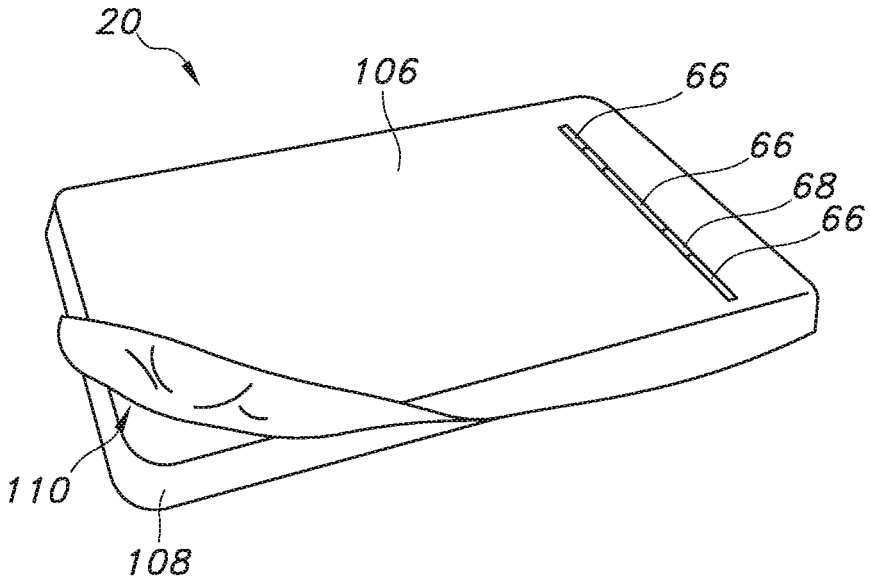
FIG. 15 is a perspective view of a component of the bedding system, in accordance with the principles of the present disclosure, with the component inverted for purposes of illustration.

In one embodiment, shown in FIG. 15, system 20 includes a sheet 106 for use with a cushion, such as, for example, a mattress 108 that does not include a bar, such as, for example, a rod 68 in order to couple mattress 108 to a base, such as, for example, base 26 or a base, such as, for example, that is fitted with a sheet, such as, for example, sheet 100 that is fitted with brackets 40 for receiving a bar, such as, for example, a rod 68 within channels 54 of brackets 40 to couple mattress 108 to the base. In some embodiments, sheet 106 is similar to a fitted sheet that can be fitted over a mattress, such as, for example, mattress 108 in the same manner as a fitted sheet is fitted over a conventional mattress. However, it is noted that sheet 106 is configured to cover the bottom surface of a mattress, such as, for example, mattress 108 that is opposite a top surface or sleep surface of the mattress that one or more sleepers lay on top of. That is, system can include sheet 106 to cover the bottom surface of mattress 108 and a traditional fitted sheet to cover the top surface of mattress 108. Sheet 106 includes one or more pockets 66 attached thereto in a manner that is the same or similar to the manner in which pockets 66 are attached to mattress 28 and a rod 68 inserted into channels of pockets 66 in a manner that his the same or similar to the manner in which rod 68 of mattress 28 is inserted into pockets 66 of mattress 28. After sheet 106 is fitted over mattress 108, a base, such as, for example, base 26 can be coupled to sheet 106 by inserting rod 68 of sheet 106 into channels 54 of brackets 40 of the base in the same manner as rod 68 is inserted into channels 54 of brackets 40 of base 26, discussed above, to prevent or reduce relative movement between mattress 108 and the base. It is envisioned that sheet 106 may be used in conjunction with a base, such as, for example, base 26 that has brackets 40 affixed thereto or with a conventional base that does not have brackets 40 affixed thereto, but is fitted with a sheet, such as, for example, sheet 100 having brackets 40 affixed thereto.

In some embodiments, sheet 106 is close fitting with mattress 108 in a manner that prevents relative movement between sheet 106 and mattress 108 when sheet 106 is fitted or otherwise coupled with mattress 108. For example, in some embodiments, sheet 106 may be made of stretch tight fabric that has at least some elasticity that allows sheet 106 to be expanded to fit over mattress 108 and then contract after sheet 106 is fitted over mattress 108 to form a close fit with mattress 108. In some embodiments, mattress 108 has a volume that is greater than a volume defined by a cavity 110 of sheet 106 such that sheet 106 must be stretched to dispose mattress 108 within cavity 110. It is envisioned that the volume of cavity 110 will closely match the volume of mattress 108 after mattress 108 is disposed within cavity 110 due to the elastic properties and/or characteristics of sheet 106, for example.

Figure 16:
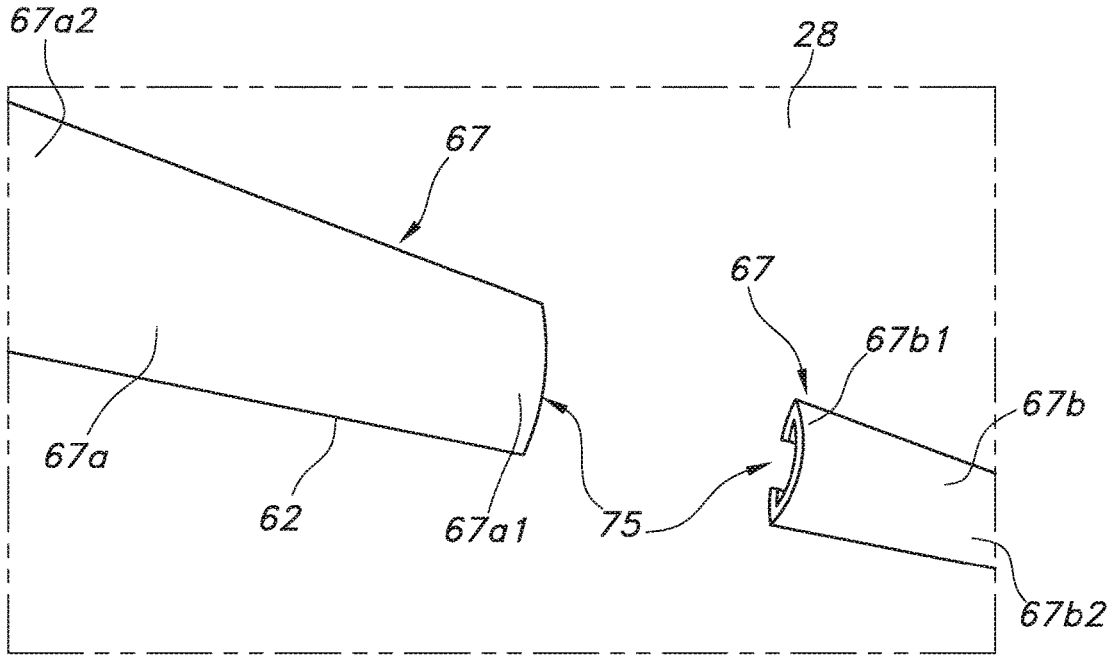
FIG. 16 is a perspective view of one embodiment of a component of a bedding system, in accordance with the principles of the present disclosure.
Figure 17:
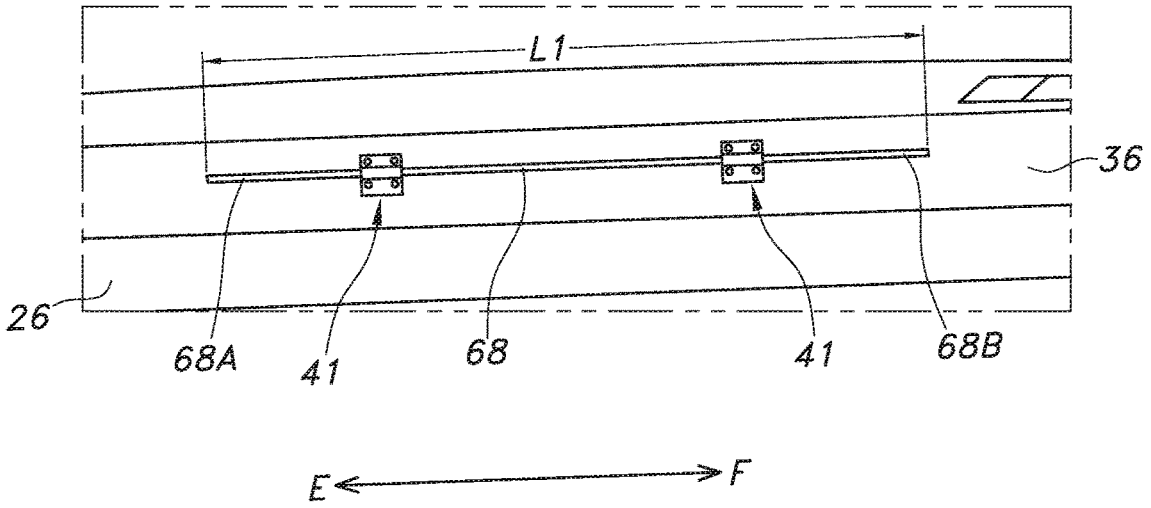
FIG. 17 is a perspective view of one embodiment of a component of the bedding system shown in FIG. 16, in accordance with the principles of the present disclosure.
Figure 18:
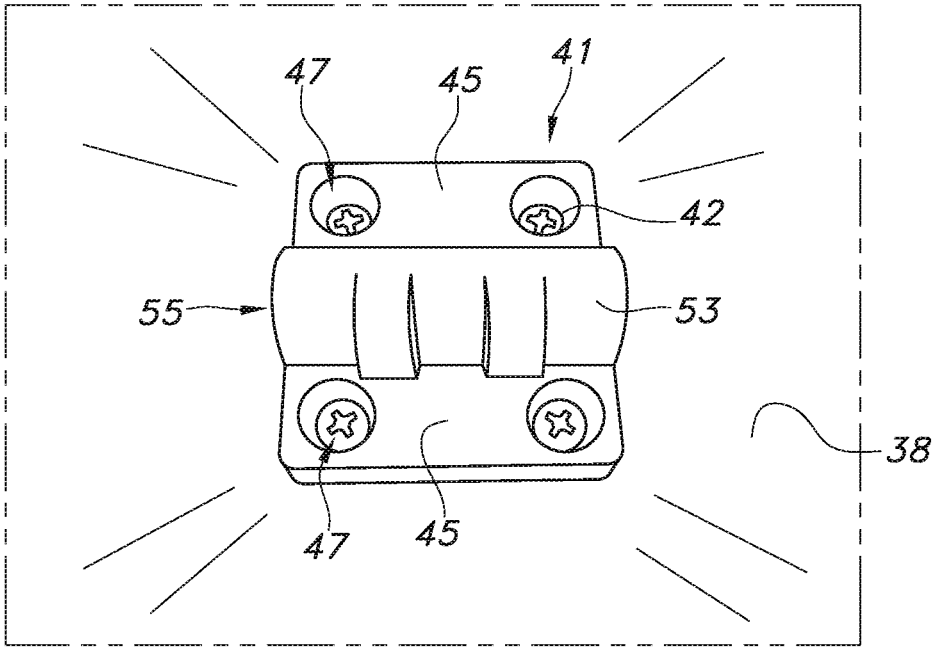
FIG. 18 is a perspective view of one embodiment of a component of the bedding system shown in FIG. 16, in accordance with the principles of the present disclosure.

In one embodiment, shown in FIGS. 16-20, rod 68 is coupled to base 26, rather than mattress 28. In particular, one or a plurality of clips, such as, for example, brackets 41 are coupled to surface 38, as shown in FIG. 17, for coupling rod 68 to base 26. In some embodiments, brackets 41 are each coupled to surface 38 using a plurality of screws 42, as shown in FIG. 18, for example. In particular, brackets 41 each include a body 45 and spaced apart holes 47 that each extend through a thickness of body 45. Screws 42 are inserted through holes 47 and into surface 38 to couple brackets 41 to surface 38. However, it is envisioned that brackets 41 may be coupled to surface 38 in any manner that prevents relative movement between brackets 41 on surface. For example, it is envisioned that brackets 41 may be variously coupled to surface 38, such as, for example, monolithic, integral connection, frictional engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, all or only a portion of each of brackets 41 is fabricated from a deformable material. In some embodiments, all or only a portion of each of brackets 41 is fabricated from a pliable, low-friction material, such as, for example, silicone, polyurethane, silicone-polyurethane copolymers, polymeric rubbers, polyolefin rubbers, elastomers, rubbers, thermoplastic elastomers, thermoset elastomers and elastomeric composites. In some embodiments, all or only a portion of each of brackets 41, such as for example, each of bodies 45 is fabricated from a semi-rigid or rigid configuration, relative to other components of brackets 41, such as, for example, loops 53. For example, in some embodiments, bodies 45 are each made from a first material and loops 53 are each made from a second material that is different and more deformable than the first material. In some embodiments, bodies 45 and loops 53 are each made from the same material and loops 53 are configured to deflect and/or deform relative to bodies 45 due to a difference in material characteristics, such as, for example, thickness. For example, in some embodiments, loops 53 each have a thickness that is less than thicknesses of bodies 45 to allow loops 53 to deflect and/or deform relative to bodies 45.

Figure 19:
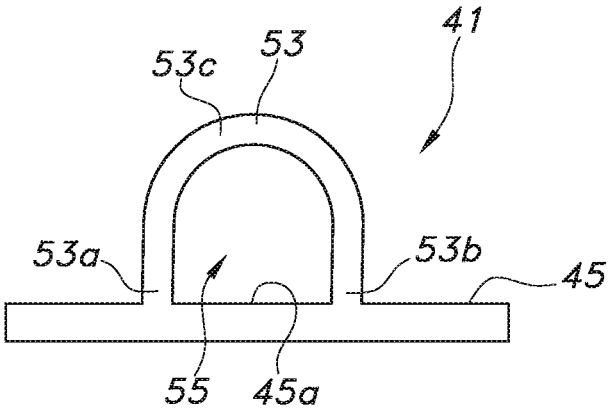
FIG. 19 is an end view of one embodiment of a component of the bedding system shown in FIG. 16, in accordance with the principles of the present disclosure.
Figure 20:
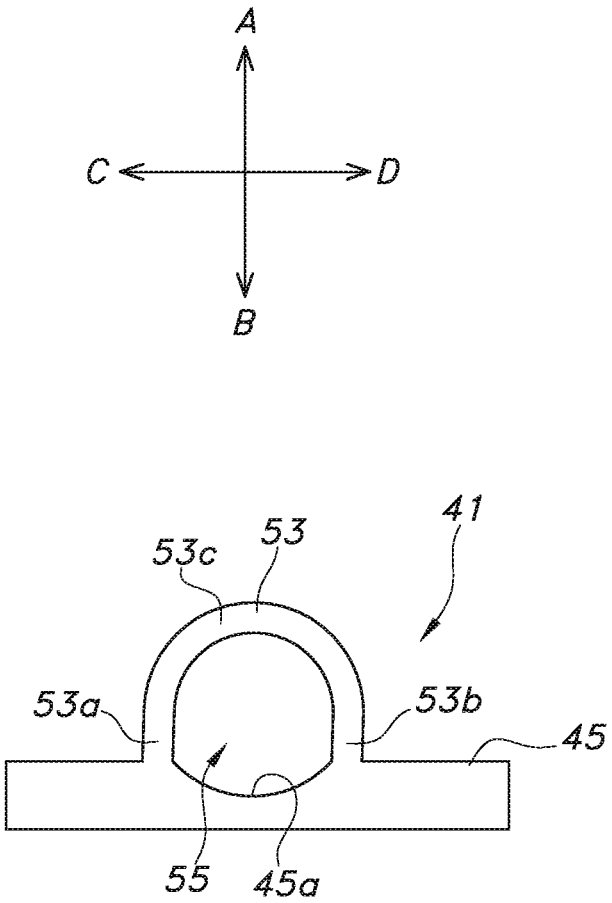
FIG. 20 is an end view of one embodiment of a component of the bedding system shown in FIG. 16, in accordance with the principles of the present disclosure.

Loops 53 are configured for disposal of rod 68 and each extend from a top surface 45*a* of a respective one of bodies 45 include an end 53*a* that is coupled to a first portion of the respective one of bodies 45 and an opposite end 53*b* that is coupled to a second portion of the respective one of bodies 45, as shown in FIGS. 19 and 20, for example. Loops 53 each extend continuously between end 53*a* and end 53*b* such that there are no gaps, openings, apertures, etc. between end 53*a* and end 53*b*. Surface 45*a* and an inner surface 53*c* of loop 53 define a passageway 55 configured for disposal of rod 68. In some embodiments, brackets 41 enclose a circumference of at least a portion of rod 68 within passageway 55. In some embodiments, passageway 55 may have various cross section configurations, such as, for example, circular, oval, oblong, triangular, rectangular, square, polygonal, irregular, uniform, non-uniform, variable, tubular and/or tapered. In some embodiments, passageway 55 has a cross section configuration that matches that of rod 68 in a manner that prevents relative movement between bracket 41 and rod 68 in the directions shown by arrows A, B, C and D in FIG. 20. That is, while relative brackets 41 are each configured to allow rod 68 to move within passageways 55 in the directions shown by arrows E and F in FIG. 17, the matching configuration of rod 58 and passageways 55 prevents relative movement between bracket 41 and rod 68 in the directions shown by arrows A, B, C and D in FIG. 20. In some embodiments, surface 45*a* is concave and/or includes a concave groove, as shown in FIG. 20, such that passageway 55 has a circular cross sectional configuration that matches the circular cross sectional configuration of one embodiment of rod 68. In some embodiments, loops 53 are each integrally and/or monolithically formed with one of bodies 45. In some embodiments, loops 53 are each permanently fixed relative to one of bodies 45 such that loops 53 cannot be removed relative from a respective one of bodies 45 without breaking one of loops 53 that is associated with the respective one of bodies 45 and/or the respective one of bodies 45.

In one embodiment, loop 53 can be configured so that it can be opened and closed about a pivot point so that when a rod is inserted into channel 55 a portion of 53 closes to extend continuously between end 53*a* and end 53*b* closing the opening. In one embodiment, bracket 41 is in the form of a pinch clasp which is a clasp that when one end is pinched two claws open up to receive the rod and once the pinched end is released the opening closes again to enclose the rod, for example a bracelet clasp. In one embodiment, bracket 41 is a carabiner-type clasp which is a d-shaped or oblong ring with one spring-hinged side that can be opened to expose a channel in which the rod can be inserted into and closed once the rod is in the clasp. The channel can have various shapes including, curved, not curved, round, flat, oblong, elliptical, square, rectangular, notched or any other configuration. Bracket 41 can be configured with or without mounting hole that are used to attach the bracket to the base and/or the mattress. If the bracket does not have mounting holes, the bracket can be welded, glued, pressed for attachment to the mattress or base.

Rod 68 is positioned within passageways 55 such that opposite ends 68*a*, 68*b* of rod 68 are not positioned in passageways 55, as shown in FIG. 17. That is, ends 68*a*, 68*b* are exposed when other portions of rod 68 are positioned within passageways 55 to allow ends 68*a*, 68*b* to be coupled to mattress 28 via pockets 67 of mattress 28. In particular, mattress 28 includes one or a plurality of pockets 67 coupled to panel 60. Pockets 67 may include a pocket 67*a* and a pocket 67*b*, wherein pockets 67*a* and 67*b* are spaced apart from one another, as shown in FIG. 16, for example. Pockets 67*a*, 67*b* are the same as or similar to pocket 66*a*, pocket 66*b* and/or pocket 66*c* and each define a cavity 75 therein. Cavity 75 of pocket 67*a* is configured for disposal of end 68*a* and cavity 75 of pocket 67*b* is configured for disposal of end 68*b*. In some embodiments, ends 68*a*, 68*b* are configured for disposal within pockets 67*a*, 67*b* such that brackets 41 are positioned between pockets 67*a*, 67*b*. In some embodiments, pockets 67*a*, 67*b* are coupled to panel 60 via stitching, for example. However, it is also envisioned that pockets 67*a*, 67*b* may be variously connected with panel 60, such as, for example, monolithic, integral connection, frictional engagement, threaded engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, pocket 67*a* includes opposite ends 67*a*1, 67*a*2, wherein end 67*a*1 includes an opening that is in communication with cavity 75 of pocket 67*a* for insertion of rod 68 therethrough and an opposite end 67*a*2 that is closed to prevent insertion of rod 68 into cavity 75 of pocket 67*a* through end 67*a*2 and/or prevent movement of end 68*a* through end 67*a*2. Likewise, pocket 67*b* includes opposite ends 67*b*1, 67*b*2, wherein end 67*b*1 includes an opening that is in communication with cavity 75 of pocket 67*b* for insertion of rod 68 therethrough and an opposite end 67*b*2 that is closed to prevent insertion of rod 68 into cavity 75 of pocket 67*b* through end 67*b*2 and/or prevent movement of end 68*b* through end 67*b*2.

In operation and use, mattress 28 is coupled to base 26 by placing mattress 28 on top of base 26 such that panel 62 faces surface 38. Mattress 28 is manipulated to position end 68*a* within cavity 75 of pocket 67*a* and end 68*b* within cavity 75 of pocket 67*b*. This allows mattress 28 to remain in place relative to base 26 as ends of base 26 move and/or rotate relative to one another, as sleepers get in and out of bed and while sleepers are lying on top of mattress 28. To remove mattress 28 from base 26, mattress 28 is manipulated to remove end 68*a* from cavity 75 of pocket 67*a* and to remove end 68*b* from cavity 75 of pocket 67*b*. Mattress 28 can then be lifted, for example, away from base 26 and for independent movement relative to base 26.

In some embodiments, a kit is provided that includes one or more of the components of bedding system 20 discussed herein. For example, the kit may include one or more bases 26, one or more mattresses 28, one or more sheets 100, one or more sheets 106, one or more conventional mattress bases and/or one or more conventional mattresses. In one embodiment, the kit includes one conventional mattress base, such as for example, base 102, one or more sheet 100, one conventional mattress, such as, for example, mattress 108 and one or more sheet 106 to allow mattress 108 to be coupled to base 102 in a manner that prevents relative movement between mattress 108 and base 102 using sheets 100, 106. In some embodiments, the kit includes other bedding items. For example, the kit may include bed sheets, pillows, pillow cases, a blanket or comforter, etc.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising:

a base comprising a bracket; and a cushion comprising a rod, the rod being configured to removably engage the bracket to couple the cushion to the base in a manner that prevents relative movement between the cushion and the base, wherein the bracket comprises a body, the bracket defining a groove extending into a surface of the body and comprising and a flange extending from the body, the groove and an inner surface of the flange defining a channel, the rod being disposed in the channel when the rod engages the bracket.

2. The bedding system recited in claim 1, wherein the rod is configured to engage the bracket in a snap-fit configuration.

3. The bedding system recited in claim 1, wherein the bracket comprises a body and a flange extending from the body, the rod being positioned between the flange and the body when the rod engages the bracket.

4. The bedding system recited in claim 1, wherein the flange has a first end connected directly to the body and an opposite second end, the bracket defining a gap between the second end and the body, the gap being in communication with the channel, the rod having a diameter greater than a width of the gap from the second end to the body.

5. The bedding system recited in claim 1, wherein the rod is configured to be inserted into and removed from the channel, the flange being configured to deflect relative to the body as the rod is inserted into the channel.

6. The bedding system recited in claim 1, wherein the rod is configured to be inserted into and removed from the channel, the channel being configured to expand as the rod is inserted into the channel.

7. The bedding system recited in claim 1, wherein the rod is configured to be inserted into and removed from the channel, the flange being configured to deflect relative to the body as the rod is removed from the channel.

8. The bedding system recited in claim 1, wherein the rod is configured to be inserted into and removed from the channel, the channel being configured to expand as the rod is removed from the channel.

9. The bedding system recited in claim 1, wherein the rod has a cylindrical configuration and the channel has a shape that conforms to the cylindrical configuration.

10. The bedding system recited in claim 1, wherein the groove is concave and the flange is C-shaped.

11. The bedding system recited in claim 1, wherein the bracket comprises spaced apart first and second brackets.

12. The bedding system recited in claim 11, wherein the brackets each comprise a body, the brackets each defining a groove extending into a surface of the body of a respective one of the brackets and comprising and a flange extending from the body of a respective one of the brackets, the groove of a respective one of the brackets and an inner surface of the flange of a respective one of the brackets defining a channel, the channels being coaxial, the rod being disposed in the channels when the rod engages the brackets.

13. The bedding system recited in claim 1, wherein the bracket is coupled to the base by a plurality of screws.

14. The bedding system recited in claim 1, wherein the cushion comprises opposite top and bottom panels and a cushioning material therebetween, the cushion comprising a pocket coupled to the top panel, the rod being positioned in the pocket.

15. The bedding system recited in claim 14, wherein the pocket is spaced apart from the bracket when the rod engages the bracket.

16. The bedding system recited in claim 1, wherein the cushion comprises opposite top and bottom panels and a cushioning material therebetween, the cushion comprising spaced apart pockets coupled to the top panel, the rod being positioned in the pockets.

17. The bedding system recited in claim 16, wherein the pockets are spaced apart from the bracket when the rod engages the bracket.

18. A bedding system comprising:

a base comprising spaced apart first and second brackets, the brackets each including a body, a groove extending into the body and a flange extending from the body such that the groove and the flange define a channel, the channels being coaxial; and a mattress comprising opposite top and bottom panels and a fill material therebetween, the mattress comprising pocket coupled to the top panel, the mattress comprising a rod positioned in the pocket, the rod being configured to be removably disposed in the channels to couple the mattress to the base in a manner that prevents relative movement between the mattress and the base.

19. A bedding system comprising:

a base comprising spaced apart first and second brackets, the brackets each being coupled to the base by a plurality of screws, the brackets each including a body, a groove extending into the body and a flange extending from the body such that the groove and the flange define a channel, the brackets each including a gap between the flange and the body, the gap being in communication with the channel, the channels being coaxial; and a mattress comprising opposite top and bottom panels and a fill material therebetween, the mattress comprising spaced apart pockets coupled to the top panel, the mattress comprising a rod positioned in the pockets, the rod having a diameter greater than widths of the gaps, the rod being configured to be removably disposed in the channels to couple the mattress to the base in a manner that prevents relative movement between the mattress and the base.

* * * * *